United States Patent [19]

Edwards

[11] 4,058,107

[45] Nov. 15, 1977

[54] COMBINATION ISOBARIC STEAM-HEATER AND ENCLOSURE FOR USE WITH FIREPLACES

[75] Inventor: Harrison F. Edwards, Norwich, N.Y.

[73] Assignee: Norwich Laboratory, Inc., Norwich, N.Y.

[21] Appl. No.: 701,689

[22] Filed: July 1, 1976

[51] Int. Cl.[2] ..... F24B 7/06

[52] U.S. Cl. ..... 126/121; 126/132; 126/140; 126/200; 237/8 R; 237/56

[58] Field of Search ..... 126/138, 140, 202, 200, 126/198, 132, 133; 52/304, 616; 237/51, 19, 57, 59, 61, 8 R, 56

[56] References Cited

U.S. PATENT DOCUMENTS

| | | | |
|---|---|---|---|
| 3,368,545 | 2/1968 | Ibbitson | 126/121 |
| 3,958,755 | 5/1976 | Cleer, Jr. | 126/132 |
| 4,014,312 | 3/1977 | McKelvey | 126/198 |
| 4,019,677 | 4/1977 | Dotschkal | 126/132 |

*Primary Examiner*—John J. Camby
*Assistant Examiner*—Larry I. Schwartz
*Attorney, Agent, or Firm*—H. Gibner Lehmann; K. Gibner Lehmann

[57] ABSTRACT

A steam-type fireplace heat-extraction apparatus, including an enclosure for utilizing the heat generated in a fireplace, comprising an isobaric or atmospheric, superheated steam system combined with a unique enclosure, said enclosure comprising a fireplace frame having vertical side members and horizontal top and bottom members, with two novel door structures which are hingedly carried by the fireplace frame. Each door structure comprises double panes of tempered glass disposed in spaced, parallel relation, held by a door frame which extends around the peripheral portions of the panes and confines the same. The door frames have special ventilating holes located adjacent the top and bottom members of the fireplace frame, which enable air from the room to be drawn into the space between the panes and then discharged, to not only provide heat to the room but also at the same time hold the temperature of the glass to a lower value. Several arrangements of atmospheric, superheated thermal exchangers-radiators are also disclosed, for use in conjunction with the double glass panes, to provide an exceptionally high heating efficiency with surprising simplicity as well as safety, when used with a conventional fireplace construction.

13 Claims, 13 Drawing Figures

12
14
16
18
20
22
23
24
28
30
32
35
37
40
44
50
52
54
58
4

COMBINATION ISOBARIC STEAM-HEATER AND ENCLOSURE FOR USE WITH FIREPLACES

BACKGROUND OF THE INVENTION

This invention relates generally to fireplace-type heaters, and more particularly to steam-utilizing devices of this type which improve the efficiency of a conventional fireplace without substantial modification of the basic structure thereof.

In the past, a number of systems have been proposed and produced for improving the efficiency of domestic fireplaces. Various gratings having ventilating passages, together with simple forced air devices, have become popular in recent times. While some of these have met with moderate success, there are several disadvantages to such arrangements. First, such grates remove heat from the coals and hence the fire itself, which tends to reduce the combustion temperature of the fire and thus impair the overall efficiency of the reaction. Second, no provision is typically made for limiting the flow of air into the fire. Experiments have shown that there exists an optimum air flow for a particular size fire, with flows beyond this optimum value doing nothing constructive but instead merely cooling the reaction, which actually decreases the combustion efficiency. Maximum combustion efficiency in BTU/pound of fuel occurs with the optimum (not maximum) air flow mentioned above. Most prior devices have not been able to restrict the air flow to a fire, in order to arrive at such an optimum efficiency.

Plate glass enclosures for fireplaces have had the disadvantage that the single-thickness glass became excessively heated from a large or hot fire. The natural convection from the room has been, in many cases, insufficient to maintain the glass temperature at a safe level. In addition, much of the heat from the glass and frame was merely re-radiated back into the walls of the fireplace, with a consequent loss of the useful heat available to the room.

SUMMARY OF THE INVENTION

The above disadvantages and drawbacks of prior heat-extraction systems and enclosures for fireplaces are largely obviated by the present invention, which has for an object the provision of an improved isobaric or atmospheric steam-heat apparatus for fireplaces, including a unique glass-panel enclosure, which apparatus provides greatly superior heating for the room, is especially simple in its construction and reliable in operation, and which further provides improved safety for the glass panels, from the standpoint of resistance to heat as occasioned by reasonably large fires. A related object of the invention is the provision of an improved glass-panel type enclosure which is effective in restricting the flow of air into the fire, in part by virtue of doors than can overlap the front surfaces of the frame to provide a tight seal therewith.

Still another object of the invention is to provide an improved heat-exchanger or boiler radiator unit adapted for use with the aforementioned enclosure, characterized by a capability for producing superheated steam, coupled with a surprising simplicity of construction to the end that an unusually high heating efficiency is obtainable at reasonable cost, compared with that had with conventional devices of the type heretofore known.

Yet another object of the invention is the provision of an improved heat-exchanger or boiler which incorporates a shutter and damper control, for limiting the otherwise unimpeded loss of hot gas products up the chimney.

The above objects are accomplished by a unique fireplace steam-heating apparatus having a novel fireplace enclosure comprising, in combination, a fireplace frame constituted of substantially vertical side members and substantially horizontal top and bottom members extending between and respectively connected to the side members, and a pair of double-pane, glass-panel doors which are hingedly connected to the frame.

Each of the doors is constituted as two spaced panes of tempered glass disposed in substantially parallel relation, together with spacer means for maintaining the panes in spaced-apart relation, so as to confine an air space therebetween.

The spacer means comprises part of door frames which extend completely around the edge or peripheral portions of the panes and confine and conceal the same.

Each door frame has series of ventilating holes disposed at locations adjacent the top and bottom members of the frame, whereby heated air occupying the confined air space is convected upward and outward through the holes adjacent the top member. The arrangement is such that the convected air both provides heat to the room and at the same time reduces the temperature of the panes of glass of each door.

The objects are further accomplished by an especially simple isobaric or atmospheric steam heat-exchanger or boiler unit adapted for installation between the backwall and the lintel of a fireplace, comprising an elongate finned tube arranged to be mounted horizontally in front of the backwall and constituting a boiler chamber, there being a series of heat-conducting fins carried by said tube and disposed transverse to its axis for extracting heat from the hot gases released by the fire. A steam outlet port is connected with the boiler chamber, as is also a water inlet port.

Means carried by the tube are provided, defining a shutter mechanism for limiting the flow of hot gases past the heat-conducting fins, and in addition a flapper damper is provided and pivotally mounted on the tube for selectively channeling hot gases toward the fins, or enabling a limited by-passing of a portion of the gases past the fins and up the fireplace chimney.

The unique combination provided by the invention of the double-glass pane enclosure and the simple, atmospheric steam heat-exchanger or boiler has been found to produce greatly increased efficiency from the fire. The combustion temperatures are maintained relatively high due to the elimination of excessive air being supplied to the fire, and reduction of radiation losses. The higher combustion temperatures result in the producing of superheated steam in an atmospheric system, whereby there is combined a maximum heating efficiency with low overall cost and great safety.

Other features and advantages will hereinafter appear.

In the drawings, illustrating several embodiments of the invention:

Referring first to FIGS. 1–4 and in accordance with the present invention there is illustrated a unique double-glass pane fireplace enclosure, constituting part of a low-pressure or atmospheric steam-heater apparatus as provided for a fireplace in a room of a building or home. The improved enclosure comprises a fireplace frame which has substantially vertical side members 12, 14, and horizontal top and bottom members 16, 18, in conjunction with double glass doors 20, 22 which are carried by means of hinges 23 that are secured to the top and bottom members 16, 18.

Figures 4, 5, 6, 7, 8, 9:
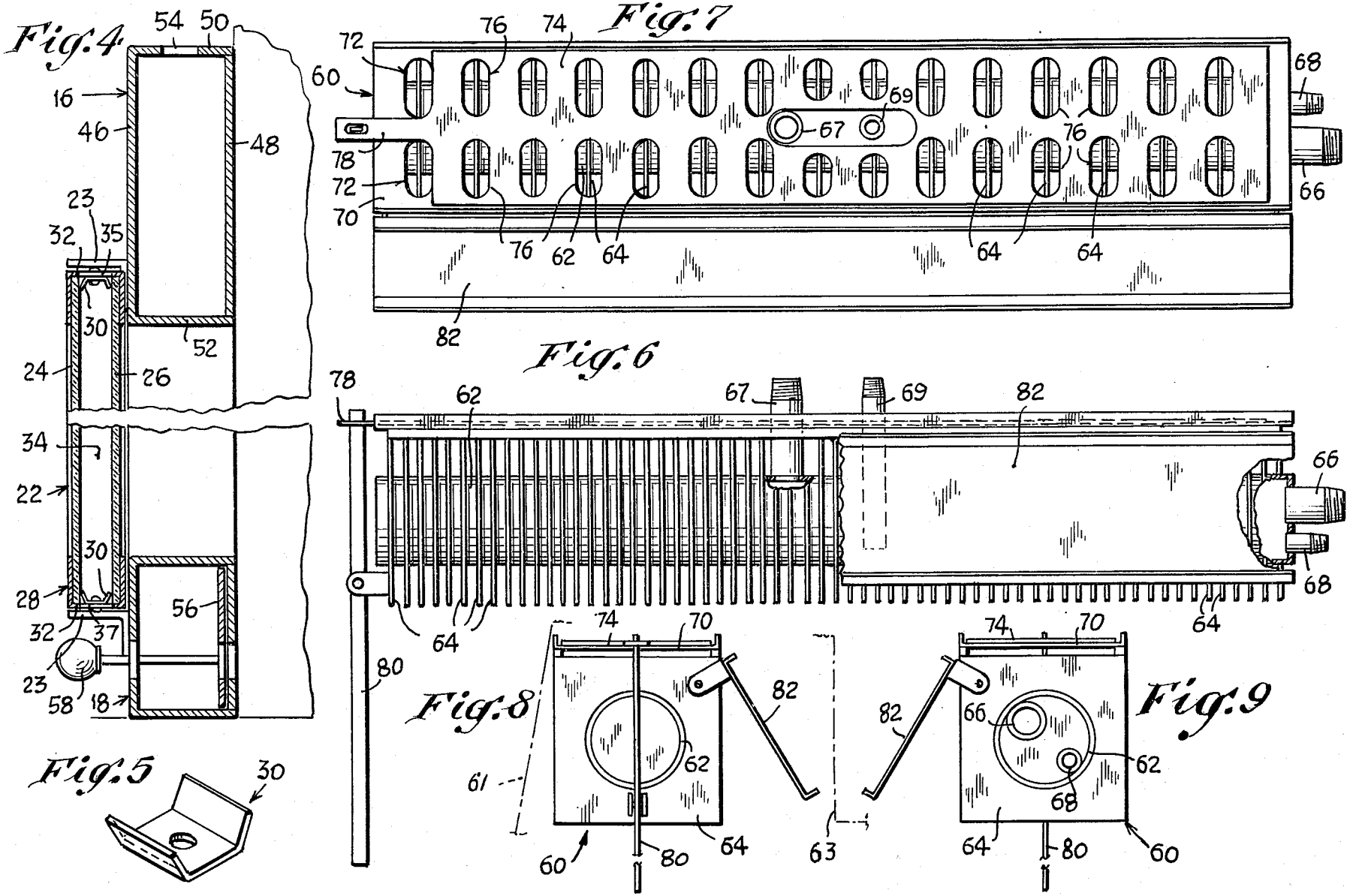
FIG. 4 is a vertical section taken on line 4—4 of FIG. 1.
FIG. 5 is a perspective view of a spacer clip employed in the enclosure of FIGS. 1–4.
FIG. 6 is a front elevational view of an atmospheric steam heat-exchanger or boiler unit as employed with the double-pane enclosure of FIGS. 1–4.
FIG. 7 is a top plan view of the heat-exchanger of FIG. 6.
FIG. 8 is a left end elevational view of the heat-exchanger of FIGS. 6 and 7, shown in a typical fireplace installation, mounted between the backwall and the lintel.
FIG. 9 is a right end elevational view of the heat-exchanger unit of FIGS. 6–8.

As shown particularly in FIG. 4, the door 22 consists essentially of two panes of glass 24, 26 which are disposed in spaced apart parallel relation. Extending completely around the door 22 is a door frame 28 constituted as a channel member which confines and conceals the edge portions of the glass panes 24, 26. The panes 24, 26 are maintained in spaced relation by means of a series of spring clips 30 which are riveted to the connecting web portion 32 of the channel member 28. Such clips are illustrated in FIG. 5, and are preferably constituted of resilient or spring metal. In the illustrated embodiment, four such clips 30 are shown for the door 22, two being carried by the channel 28 adjacent the top member 16, and two being carried by the channel 28 adjacent the bottom member 18. The door 20 is of similar construction, comprising a pair of spaced apart glass panes disposed in parallel relation, and a channel member similar to that designated 28 in FIGS. 1 and 4.

Figures 1, 2, 3:
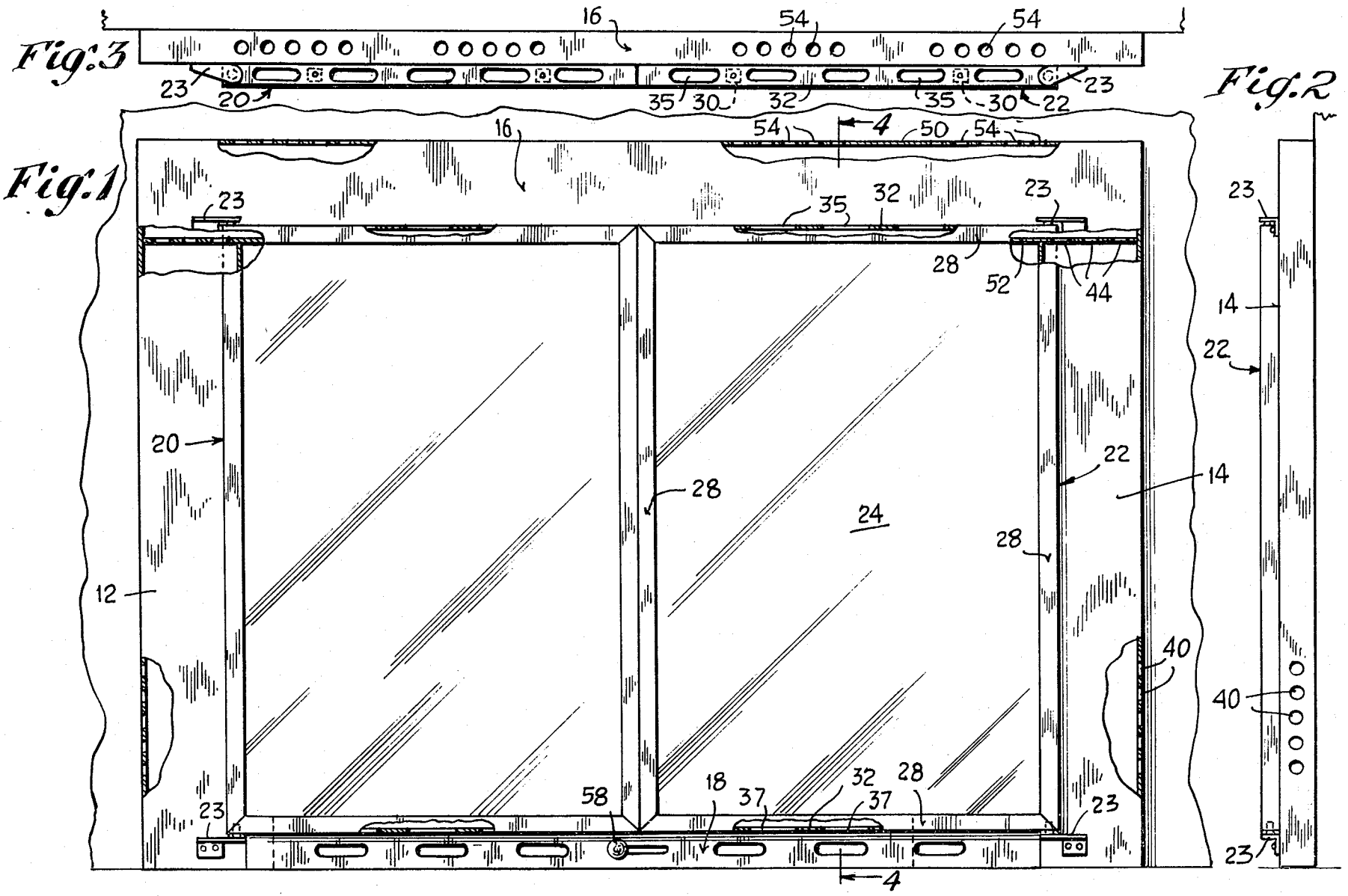
FIG. 1 is a front elevational view of an improved double-pane glass enclosure unit as provided by the present invention, shown installed in a typical fireplace of a home or other building.
FIG. 2 is a right side elevational view of the enclosure of FIG. 1.
FIG. 3 is a top plan view of the enclosure of FIGS. 1 and 2.

By the present invention, the doors 20, 22 enable a hotter enclosed fireplace fire to be had with safety, thereby making possible the production of superheated steam in an isobaric system. In effecting this, the panes of glass 24, 26 and channel 28 are arranged to define an air space 34 through which air can be freely convected, even when the doors 20, 22 are closed. Referring to FIGS. 1 and 3, it can be seen that the web portion of the channel 28 comprises a series of slots or ventilating holes 35 in the vicinity of the top member 16. Similarly, a second series of slots 37 is provided in the channel 28, adjacent to the bottom member 18. By such an arrangement, air occupying the space 34 becomes heated due to its proximity to the fire and glass panes 24, 26, and it consequently caused to rise and exit through the ventilating holes 35. In a similar manner, air from the room is drawn into the holes 37 in the channel 28. There is thus established an upward flow of air from the room, into the air space 34, and out the ventilating holes 35 in the top of the door 22 and back into the room. The remaining door 20 is provided with ventilating holes similar to those designated 35, 37 of the door 22. Such an arrangement has been found to not only provide heat to the room, but in addition, the temperature of the glass panes 24, 26 is maintained at a safe level, due to the cooling effect of the convected air, while enabling a hotter fire to be maintained for purposes of steam superheating. Experiments have shown that the reduction in temperature of the glass panes can be as much as 200° F. by virtue of the provision of the ventilating holes. Accordingly, the danger of the glass cracking where an excessively hot fire is being employed, is greatly reduced.

In accordance with the invention, the side members 12, 14 of the fireplace frame are of hollow construction and have the form of box sections. Referring to FIG. 1, a series of air inlet or ventilating holes 40 is provided in the side wall of the member 14. The upper end of the member 14 is open, and a series of notches or holes 44 constituting inlet ports is provided in the top member 16 where it joins the vertical side member 14. As shown in FIG. 4, this top member 16 is also in the form of a box section having sides 46, 48, 50, 52. In addition, the side 50 includes a series of air discharge ports 54 as shown. By such an arrangement, cold air from the room can flow into the holes 40, up through the hollow interior of the vertical side member 14, through the ports 44 and out the discharge ports 54. Such an arrangement has been found to provide a desirable cooling to the enclosure frame, reducing the overall temperature to a safe value, while at the same time providing additional heat to the room.

The bottom member 18 is also constituted as a box section, and includes a shutter or slide 56 which is operated by a handle 58.

Referring again to FIGS. 2 and 4, it can be seen that the top and bottom members 16, 18, as well as the side members 12, 14 have front surfaces while lie in a common plane. The doors 20, 22 are seen to overlap the top and bottom members, as well as the side members, thus providing an improved seal over that obtainable where the doors are completely nested between the fireplace frame members. In addition, such construction enables unimpeded flow of air from the room into the air space 34 of the door 22, and out the top ventilation holes 35 (FIG. 1). Accordingly, air flow to the fire is capable of being closely controlled by means of the shutter 56. This is important in providing an optimum air flow to the fire, wherein the combustion efficiency is maximized, and the combustion temperature is greatest. Accordingly, the overlapping construction of the doors 20, 22 and the fireplace frame constituted of the members 12, 14, 16, 18, is seen to be an important feature of the present invention.

Referring now to FIGS. 6–9 and in accordance with the present invention there is provided an improved superheating boiler or heat-exchanger unit adapted for use in an isobaric system, said unit being generally designated by the numeral 60 and being arranged for installation in a fireplace between the backwall 61 and the lintel 63 thereof. This type of installation is shown in FIG. 8. The heat-exchanger 60 is especially arranged for use in combination with the enclosure of FIGS. 1–5. In extracting the maximum amount of heat from a fire, I have found that it is desirable to be able to restrict the flow of air into the fire to an optimum value. Values of air flow beyond this optimum point result in a decrease in combustion efficiency. The additional air provides only a cooling effect to the material being burned, without adding any benefit, since ample oxygen is already available to the fire when the optimum value of air flow is reached. In achieving a maximum combustion temperature, air flow is restricted by the use of the overlapping doors 20, 22 of the enclosure of FIGS. 1–4, wherein the air flow is virtually completely regulated by the shutter 56. I have found by opening the shutter 56 slightly, maximum heat from the fire is obtained, in the form of hot gases directed upwardly toward the chimney. The present heat-exchanger construction is especially adapted to extract a large portion of the heat from these gases, and to transfer it back into the room of the building by converting water to superheated steam in an atmospheric or isobaric system, part of which includes the double-glass convection doors described above.

As shown in FIG. 6, the heat-exchanger 60 comprises a cylindrical, elongate tube 62 constituting a boiler chamber, and a series of heat-exchanger fins 64 secured to the tube 62 and disposed transverse to the axis thereof. The tube 62 is sealed with the exception of a steam outlet port 66, and a water inlet port 68. These are adapted to be connected to hoses which extend to a remote unit, as will be explained below. In order to restrict flow of the hot gases up the chimney, there is provided on the heat-exchanger 60 a two-part shutter mechanism carried directly above the fins 64. One part is stationary and comprises a plate 70 having a series of slots 72, the other part being slidable in the form of a shutter plate 74 with a similar series of slots 76. An acutator arm 78 is connected with the shutter 74, adapted to be operated by a pivotally mounted second arm 80, secured to the end most plate 64. In addition, there is provided a flapper damper 82 which is pivotally mounted on the two end fins 64, and which can be adjusted in the manner indicated in FIG. 8, to partially close off the space between the backwall 62 and the lintel 63 of the fireplace. Such an arrangement enables regulation of the flow up the chimney, and tends to retain the hot gases in the vicinity of the fins 64 for the maximum amount of time. In practice, the damper 82 is set to a position allowing only sufficient bypass of the hot gases to reduce any likelihood of smoke or carbon monoxide being forced into the room. I have found that sufficient draw can be obtained with the present apparatus, with the flapper damper 82 almost closed.

Figure 10:
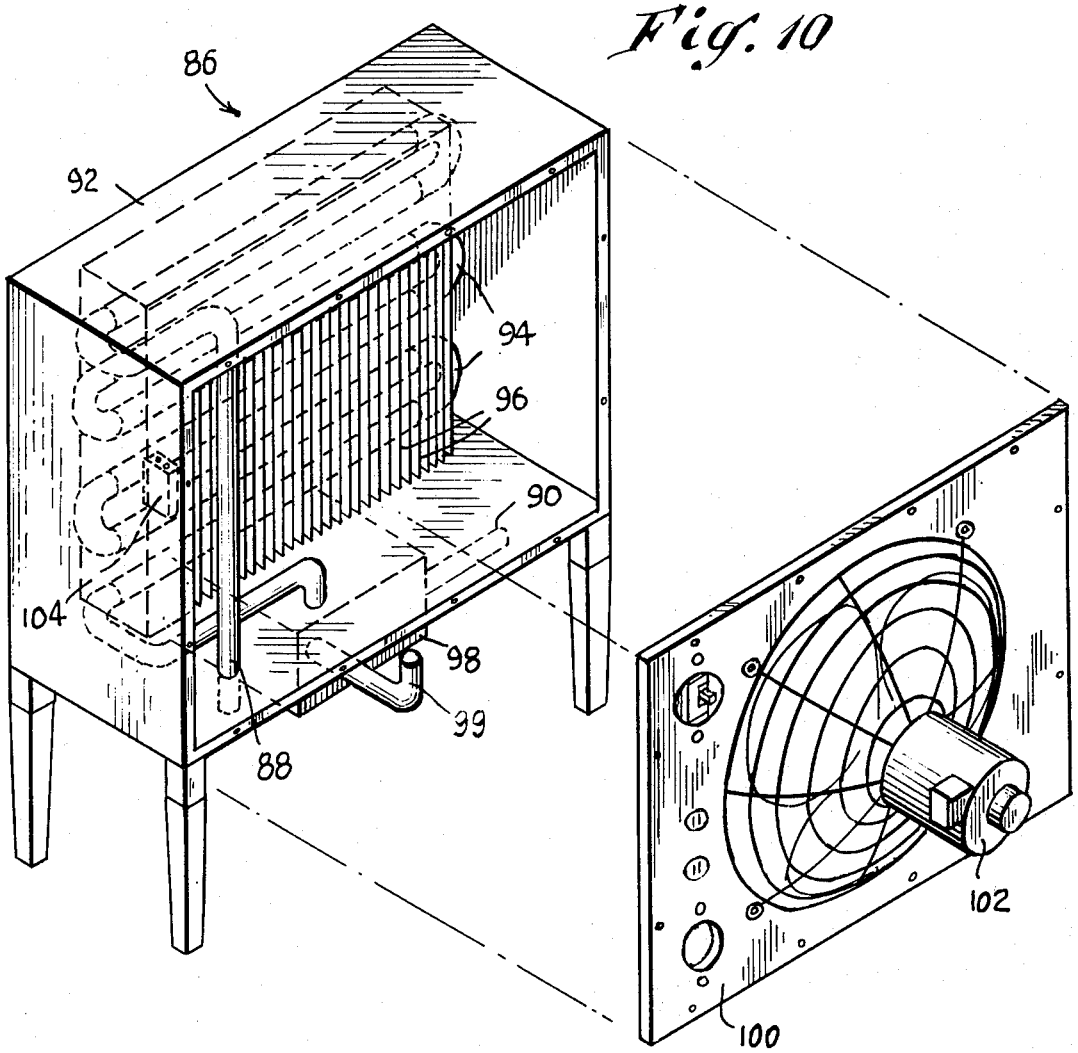
FIG. 10 is a rear perspective view of a radiator unit adapted for use with the heat-exchanger shown in FIGS. 6–8.
Figure 12:
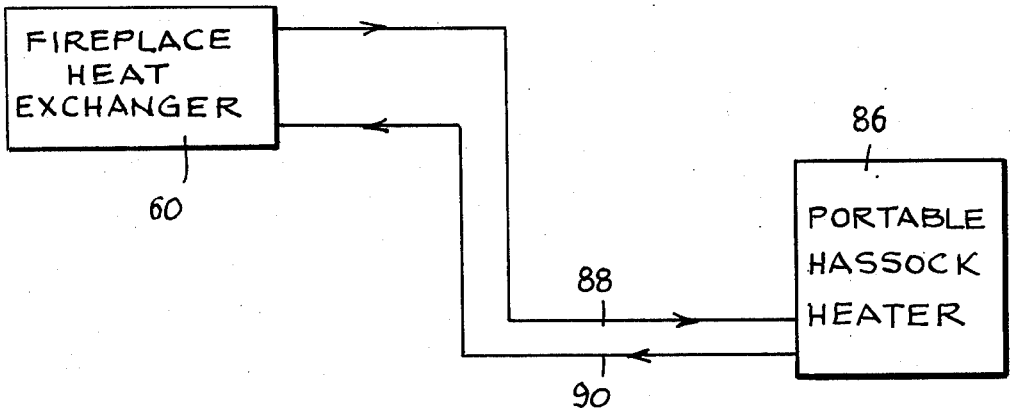
FIG. 12 is a block diagram of the isobaric, superheated steam boiler or heat-exchanger of FIGS. 6–8 and radiator unit of FIG. 11, where the radiator is shown below the level of the exchanger and condensate is pumped to the exchanger in order to be vaporized.
Figure 13:
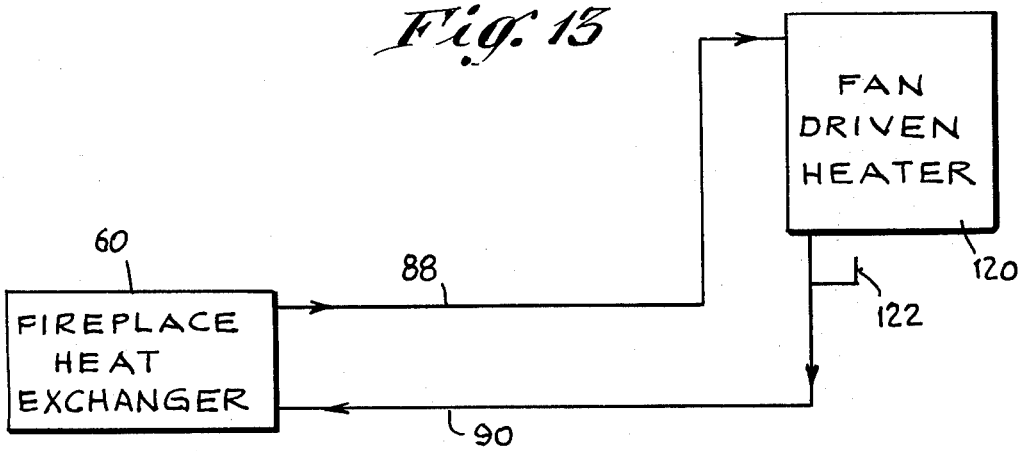
FIG. 13 is a block diagram of the boiler or heat-exchanger of FIGS. 6–8 and a modified radiator unit, wherein the condensate from the radiator is returned to the exchanger by gravity.
Figure 14:
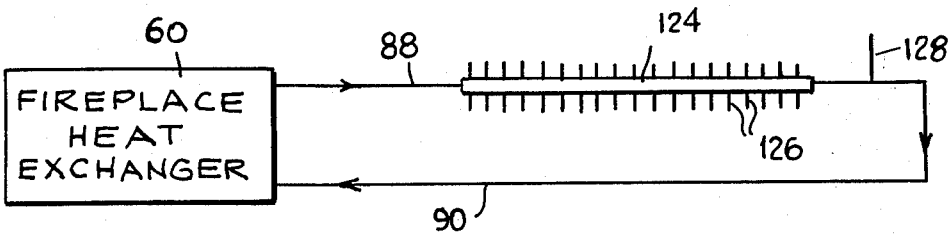
FIG. 14 is a block diagram of the boiler or heat-exchanger of FIGS. 6–8 and a further modified radiator unit, the latter comprising an elongate finned tube for distributing heat throughout a room.

The heat-exchanger 60 is adapted to be used with suitable atmospheric steam radiator devices, as depicted in FIGS. 12, 13 or 14. FIGS. 10 and 12 show a portable radiator unit generally designated 86, of the type adapted to be employed with the heat-exchanger unit 60. Fluid connections 88, 90 are made from the exchanger unit 60 to the radiator unit 86.

FIG. 10 shows the details of the radiator unit 86. The unit comprises a cabinet 92 in which there is carried a radiator device comprising a network of tubing 94 and a series of radiator fins 96. The inlet 88 of the network 94 receives steam or hot water vapor from the fireplace heat-exchanger unit 60. The outlet 90 is connected to the water inlet port 68 of the heat-exchanger 60. A sump 98 is provided, in order to store a quantity of water which replaces any loss from evaporation during the operation of the system. In the present instance, pump 99 (FIG. 11) is provided (located within the sump 98) to return the condensate from the radiator unit to the heat-exchanger unit. The casing 92 includes a cover plate 100 which carries an electric fan 102.

Figure 11:
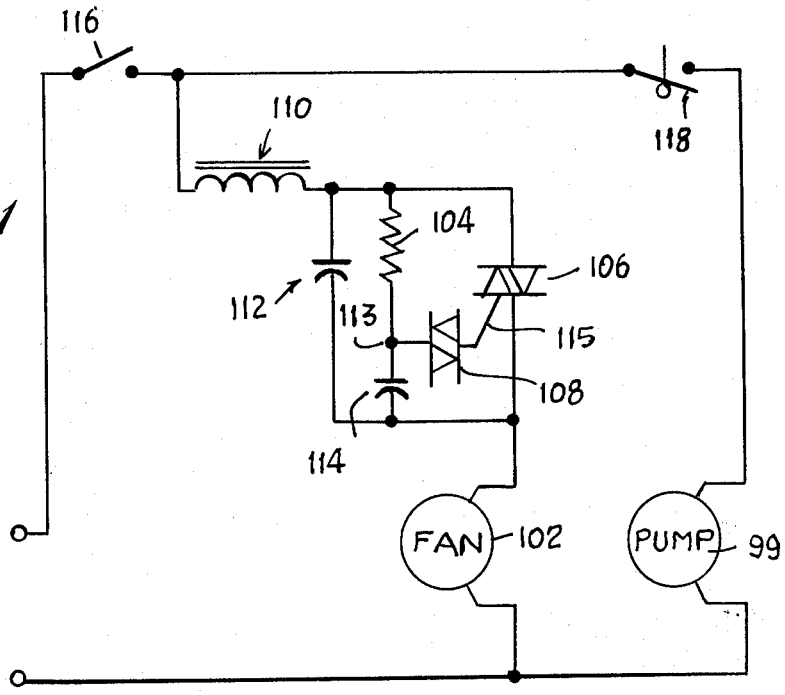
FIG. 11 is a schematic diagram of a control circuit for automatically regulating the speed of a fan in the radiator unit of FIG. 10.

In accordance with the present invention, electronic control means are provided, connected with the fan 102, for regulating the speed of the latter according to the temperature of a portion of the pipe network 94. Such a control is illustrated in FIG. 11, and is seen to comprise a thermistor 104 which is located on the pipe network 94, adjacent to the sump 98. In addition, there is provided a triac 106 and a diac 108 connected as shown, together with a choke 110, and capacitors 112, 114. A switch 116 controls power to both the fan and the pump, and a second switch 118 enables selective operation of the pump. The thermistor 104, when changing resistance in response to heat, alters the voltage of terminal 113. This changes the bias on the gate 115 of the triac, through the diac 108, cutting off more or less of the wave of the a. c. fed to the fan. The component values are selected experimentally, to provide a low speed when the temperature of the network 94 is at a relatively low point, and to provide increased voltage (duty cycle) to the fan 102 when the temperature of the network 94 increases. By such an arrangement, the fan speed can be automatically matched to the amount of heat being generated by the fireplace heat-exchanger unit 60. I have found that such an arrangement is desirable to have, in that it maximizes the heat transfer to the room from the radiator unit, under a wide variety of conditions corresponding to the amount of heat being generated in the fireplace.

Still other arrangements are shown in FIGS. 13 and 14, that illustrate fireplace heat-exchangers 60 connected with radiator units which are disposed above the level of the heat-exchanger. In FIG. 13, the exchanger 60 is connected by flexible hoses or pipes 88, 90 to a radiator unit 120 which can be similar to that illustrated in FIG. 10 with the exception that the pump can be omitted. A vent 122 is provided to enable water to be added to the system, and also to prevent excessive pressures from being built up within the system. Since the level of the radiator unit is above that of the heat-exchanger 60, water which condenses in the radiator merely flows by gravity back to the fireplace heat-exchanger, eliminating the necessity of the pump. FIG. 14 shows a similar system except that the lead 88 extends to an elongate pipe 124 having a series of heat radiating fins 126, adapted to extend around the periphery of the room, adjacent the ceiling. A fill and vent opening 128 is provided for adding water to the system. As in the case of the system of FIG. 13, the condensate from the radiator 124 can return by gravity to the heat-exchanger 60. Accordingly, no pumps are required in such an installation. In FIG. 10, the vent and fill opening is labelled 99.

Referring to FIGS. 6 and 7, it will be seen that the boiler tube 62 is provided with alternative steam exhaust and water inlet fittings 67 and 69 respectively. In circumstances where it is more convenient to make connections at the center of the fireplace, the fittings 67, 69 may be utilized in place of the end fittings 66, 68. Whichever set of fittings is used, the other set will be capped off, as can be understood.

It will now be seen from the foregoing that I have provided a unique isobaric or atmospheric (low pressure) steam heating system for use with conventional fireplaces, wherein double-paneled enclosure doors make possible a hotter fire in the fireplace, enabling the additional heat to be utilized to produce superheated steam for maximum capture and transfer of heat. Absolute safety is had against overpressures of steam because the system is open to the atmosphere and cannot build up dangerous boiler pressures. Moreover, by the provision of the atmospheric, superheated steam system set forth above there is had in addition to high thermal efficiency, a surprisingly simple and low cost construction which has a minimum of moving parts, and operates with a minimum of maintenance. No damage occurs if the system should run dry, since the heat-exchanger or boiler is capable of withstanding the maximum flue gas temperatures. If by chance the water is all exhausted, it merely becomes necessary to pour a measured quantity into the vent and filler opening, whereupon the superheated steam cycle is automatically re-established. I attribute the exceptionally high efficiency to the novel combination of atmospheric steam system involving superheated steam obtained from an enclosed fire operating at high temperatures, are made possible by the closed double-glass pane enclosure doors. Due to the thermal convection in the doors the outside glass temperatures are found to be not excessive, and instead appreciably below temperatures encountered with conventional fireplaces equipped with single tempered glass panels.

Data on the components of the circuit shown in FIG. 11 are as follows: Capacitors 112 and 114 are each 0.1 uF. Triac 106 is an SC 141B, manufactured by GE. Diac 108 is an ST2, also manufactured by GE. Choke 110 has a value of 100 uH. Thermistor 104 has a resistance of 300K at 25° C, type YS1 44014.

The isobaric system is possible regardless of the relative elevation of the radiator means with respect to the heat-exchanger or boiler, as can be understood from the foregoing description.

Variations and modifications are possible without departing from the spirit of the invention.

I claim:

1. An enclosure for a fireplace, comprising in combination:

a. a fireplace frame having substantially vertical side members and substantially horizontal top and bottom members extending between and respectively connected to the side members, b. a pair of doors and means hingedly connecting the same to the frame, said doors being adapted to close off the space encompassed thereby, c. each of said doors being constituted of two panes of tempered glass disposed in substantially parallel relation and having spacer means for maintaining said panes in closely spaced relation so as to define an air space therebetween, d. said spacer means including door frames which extend completely around the peripheral portions of the panes and confine and conceal such portions, e. said door frames having series of ventilating holes at locations adjacent the top and bottom members of the fireplace frame whereby heated air in said air space is convected upward through the holes adjacent the top member, said air being drawn into the air space through the holes adjacent the bottom member, f. said convected air providing heat to the room and at the same time reducing the temperature of both panes of glass of each door.

2. An enclosure as defined in claim 1, wherein:

a. said side, top and bottom fireplace frame members have front surfaces lying substantially in a single plane, b. said doors each having door-frame edge portions which overlap said front surfaces so as to form a substantially tight seal therewith.

3. An enclosure as defined in claim 1, wherein:

a. said spacer means comprises a plurality of clips carried by the door frame of each door and engaging the opposed surfaces of the panes thereof to maintain a given separation therebetween.

4. An enclosure as defined in claim 1, wherein:

a. said door frames comprise channels having pairs of leg portions engaging the edge portions of the glass panes, and connecting web portions containing said ventilating holes.

5. An enclosure as defined in claim 1, wherein:

a. said side members of the fireplace frame each is constituted as a box section having elongate sides and open ends to exhaust air to the associated horizontal top member, b. said top member having inlet ports at the open ends of the box sections for receiving said exhausted air, and having discharge ports for channeling such air to the room.

6. An enclosure as defined in claim 5, wherein:

a. said top member is constituted as a box section having elongate sides and shorter transverse ends, b. said air discharge ports being disposed in one of said elongate sides.

7. An enclosure as defined in claim 1, in combination with:

a. a boiler-superheater unit adapted for installation between the backwall and the lintel of the fireplace, to extract heat from hot gases released by the fire, b. said unit having a steam outlet port and a water inlet port, c. an atmospheric steam radiator unit adapted for use with said boiler unit, said radiator unit being located remote from the boiler-superheater unit, d. said radiator unit including an inlet port, an outlet port, and means providing a vent opening for venting air to the atmosphere to effect an isobaric steam system, e. means providing fluid connections between the inlet port of the radiator unit and the outlet port of the boiler unit, and between the outlet port of the radiator unit and the inlet port of the boiler unit whereby steam from the boiler unit travels to the radiator unit, condenses and releases heat thereto, and whereby condensate from the radiator can be returned to the heat exchanger unit.

8. The combination as defined in claim 7, and further including:

a. a fan carried by the radiator unit for boosting its radiating efficiency.

9. The combination as defined in claim 7, wherein:

a. said radiator unit comprises an elongate tube adapted to extend partially around the room, and b. a series of heat-radiating fins carried by said tube for improving the heat transfer therefrom to the air in the room.

10. The combination as defined in claim 7, wherein:

a. said radiator unit is located at a higher elevation than the boiler unit so that water condensate from the radiator unit can flow by gravity back to the boiler unit.

11. The combination as defined in claim 7, wherein:

a. said radiator unit is located at a lower elevation than the boiler unit, b. said radiator unit further including an electric pump for returning the water condensate to the boiler unit.

12. The combination as defined in claim 8, and further including:

a. an electrical energizing circuit connected with said fan, and b. heat responsive means located to receive heat from the radiator unit and including a thermal control connected with said energizing circuit for regulating the speed of the fan in accordance with the temperature of the radiator unit.

13. The combination as defined in claim 12, wherein:

a. said energizing circuit includes a triac, b. said heat responsive means including a diac, c. said thermal control comprising a thermistor connected to feed current to said diac.

* * * * *